US005405056A

United States Patent [19]

Mills

[11] Patent Number: 5,405,056

[45] Date of Patent: Apr. 11, 1995

[54] STEREO DISPENSING CONTAINER AND SYSTEM

[76] Inventor: Gregory B. Mills, P.O. Box 692, Balboa Station, Newport Beach, Calif. 92661

[21] Appl. No.: 165,635

[22] Filed: Apr. 1, 1994

[51] Int. Cl.[6] ..... B67D 5/52

[52] U.S. Cl. ..... 222/136

[58] Field of Search ..... 222/135, 136, 137, 145, 222/325, 326, 327, 206, 207, 209, 212, 129

[56] References Cited

U.S. PATENT DOCUMENTS

| | | | |
|---|---|---|---|
| 3,188,056 | 6/1965 | Trumbull et al. | 222/136 X |
| 3,266,671 | 8/1966 | Gelpey | 222/136 X |
| 3,620,417 | 11/1971 | Simms | 222/136 |
| 3,730,394 | 5/1973 | Woodson | 222/137 |
| 4,493,436 | 1/1985 | Brokaw | 222/137 X |
| 4,691,845 | 9/1987 | Schwartz | 222/136 X |
| 4,735,509 | 4/1988 | Rausch | 222/145 X |
| 4,801,008 | 1/1989 | Rich | 222/145 X |
| 4,811,549 | 3/1989 | Usami et al. | 222/137 X |

*Primary Examiner*—Andres Kashnikow
*Assistant Examiner*—Kenneth R. DeRosa
*Attorney, Agent, or Firm*—Morland C. Fischer

[57] ABSTRACT

A low cost stereo dispensing container (e.g. a disposable caulking cartridge) from which two part fluid products may be simultaneously dispensed in predetermined proportions relative to one another. A first material (e.g. a catalyst) is stored within a flexible blister. The blister may be adhesively affixed to a side of the container. In the alternative, the blister may be extruded or injection molded along a side of the container during manufacture. The second material (e.g. a resin) is stored within a holding chamber formed in the container alongside the blister. A plunger is moved through the container to ride over and compress the blister and thereby cause the first material to be expulsed therefrom into a spout of the container. At the same time, the volume of the holding chamber is reduced to thereby cause the second material to be simultaneously expulsed therefrom into the spout.

12 Claims, 5 Drawing Sheets

STEREO DISPENSING CONTAINER AND SYSTEM

BACKGROUND OF THE INVENTION

1. Field of the Invention

This invention relates to a relatively low cost, stereo dispensing container (e.g. a disposable caulking cartridge) and to an efficient system by which two different materials may be simultaneously expulsed from a single container in predetermined proportions relative to one another.

2. Background Art

It is frequently necessary to mix together different ingredients according to a particular ratio in order to form a composite material which depends upon a precise introduction of one ingredient to the other. For example, a catalyst and a resin are mixed together to form a fast hardening epoxy. A proper ratio of catalyst to resin is required to speed the curing and form a hard, durable epoxy. The catalyst and resin are presently carried in separate containers or tubes. The user must carefully dispense the catalyst and resin from their respective containers while making sure that the correct amounts of each will be mixed together. This is often a slow and cumbersome process and frequently results in both wasteful mistakes and inefficiency due to the duplication of activities (i.e. two containers are opened, two plungers are pushed or two tubes are squeezed, two fluid supplies are progressively mixed together, etc.).

To overcome some of the aforementioned inefficiencies, stereo dispensers have been used by which to simultaneously dispense two different materials from separate storage compartments. These dispensers resemble a syringe, but include a pair of piston assemblies that are interconnected for simultaneous movement through the respective storage compartments in which the materials to be dispensed are stored. While the piston assemblies are advantageously moved together, there is no inexpensive or easy way to change the ratio of the materials dispensed as a result of such movement. Moreover, the conventional stereo dispensers are relatively complex in construction, thereby using a greater number of component parts which results in a correspondingly increased cost of manufacture.

Examples of known dispensers, including those described above, are available by referring to one or more of the following U.S. Pat. Nos.:

3,013,697 issued Dec. 19, 1961 to Wilber Gill;
3,330,444 issued Jul. 11, 1967 to Kenneth Raypholtz;
4,014,463 issued Mar. 29, 1977 to Paul Hermann;
4,069,091 issued Jan. 17, 1978 to Dick van Manen;
4,205,766 issued Jun. 3, 1980 to Douglas White; and
5,203,839 issued Apr. 20, 1993 to Kenneth Skaggs.

SUMMARY OF THE INVENTION

A low cost stereo dispensing container is disclosed which uses an efficient system for simultaneously dispensing particular amounts of two different fluid materials stored therein according to any predetermined ratio. In the preferred embodiment, the dispensing container is a disposable caulking cartridge of the type commonly found in the construction and home improvement industries. A flexible blister extends longitudinally along an interior side of the cylinder of the caulking cartridge. The blister may be either adhesively affixed to the side of an existing caulking cartridge, or the blister may otherwise be extruded or injection molded along the side during manufacture. The blister is filled with a first material (e.g. a catalyst) and sealed at the opposite ends thereof. The remainder of the caulking tube forms a holding chamber for a base material (e.g. a resin) to be mixed with the contents of the blister in predetermined proportions relative to one another. The holding chamber communicates with the usual spout of the caulking cartridge through a passageway formed in the distal end wall of the cartridge.

An exit channel extends through the forward end of the blister. The exit channel terminates at a catalyst outlet tube which projects longitudinally from the cartridge to be surrounded by and coaxially aligned with the spout. Both the outlet tube and the spout are initially closed to prevent the leakage of catalyst and base material from their respective storage locations at the blister and holding chamber within the cartridge.

In stereo displacement operation, the tip of the spout and the leading end of the outlet tube are severed. A plunger that is initially at rest at the proximal end of the caulking cartridge is then driven distally through the interior of the cartridge towards the spout by means of a conventional caulking gun, or the like. The distal movement of the plunger through the caulking tube causes a corresponding amount of base material in the holding chamber to be expulsed by way of the spout. At the same time, the plunger rides over a portion of the blister to compress the blister and thereby cause a measured supply of catalyst to be simultaneously expulsed via the exit channel and outlet tube. The amount of catalyst expulsed is dependent upon the total volume of the blister and the distal displacement of the plunger through the interior of the cartridge. The amount of catalyst to be mixed with a known amount of the base material can be selectively changed by choosing the cross-sectional dimensions of the blister to provide a particular ratio of catalyst to base material. Accordingly, the catalyst and base material can be expulsed together so as to achieve a composite material having predetermined proportions of one material to the other.

According to an additional embodiment of the present invention, a threaded plug is carried by the plunger. The plug can be removed from the plunger to create an opening through which base material may be added to the holding chamber of the caulking cartridge. According to another embodiment, the spout of the caulking tube may be interfaced with a spray tip by which to permit the catalyst and base material to be expulsed in a particular ratio and sprayed onto a surface by means of air under pressure.

Figure 1:
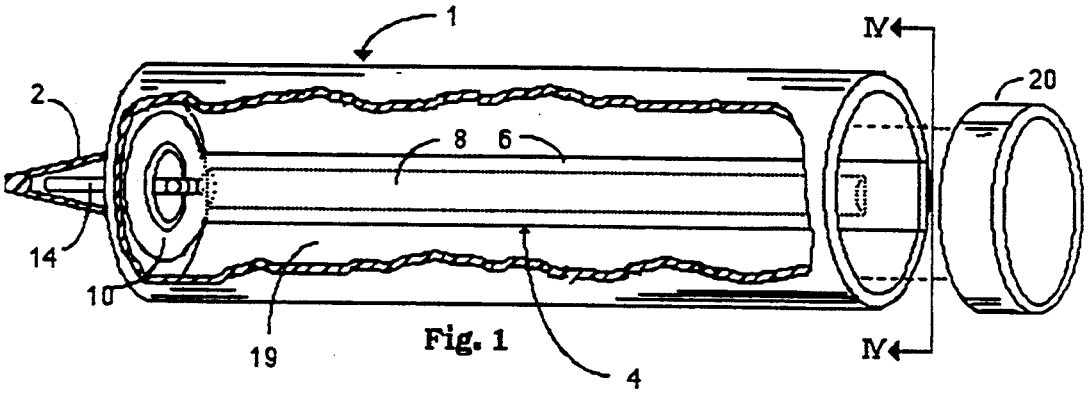
FIG. 1 is a longitudinally broken away view of a stereo dispensing container according to one embodiment of the present invention.
Figure 3:
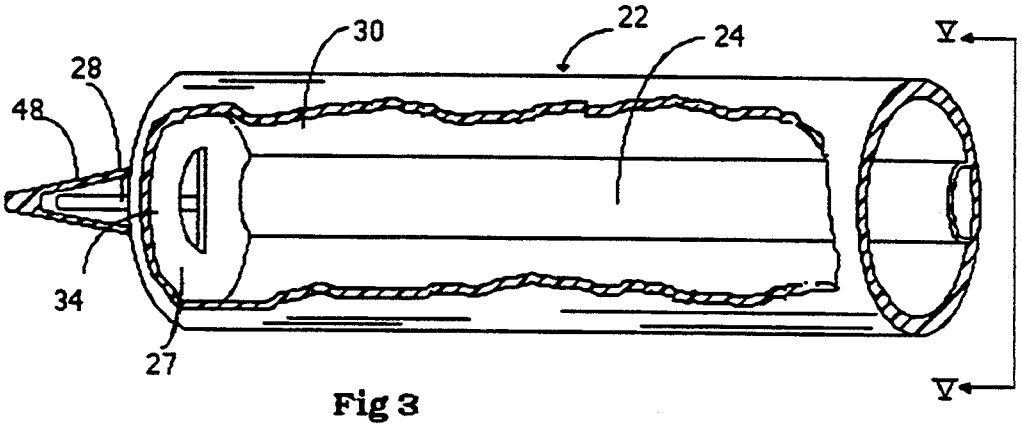
Figure 4:
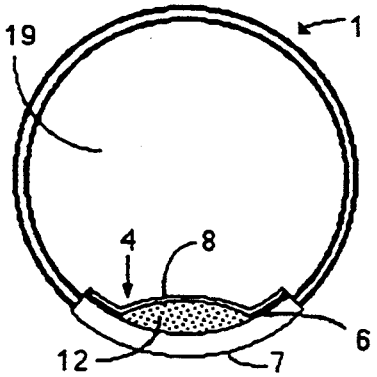
Figure 5:
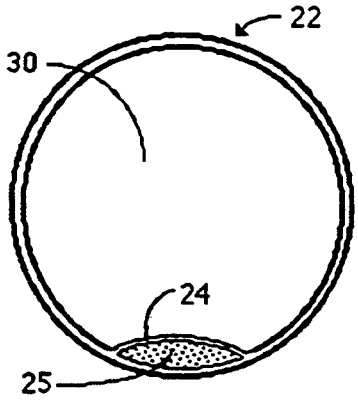
Figure 6:
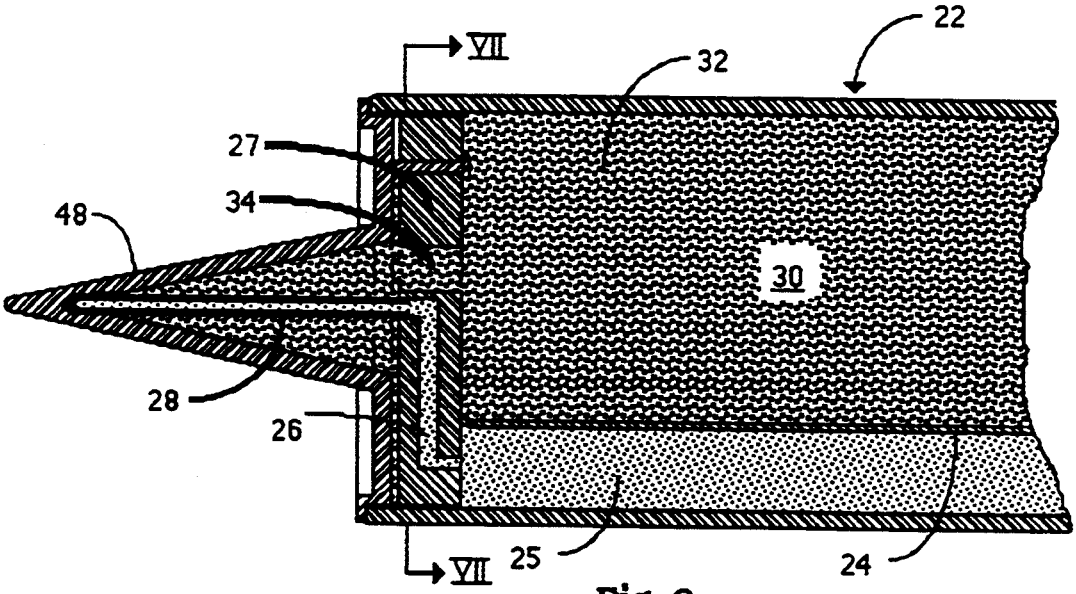
Figure 7:
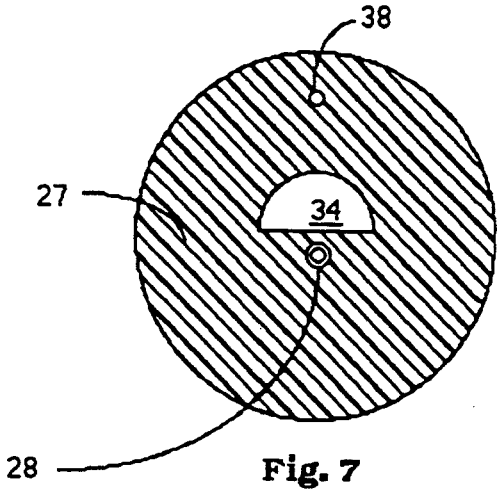
Figure 8:
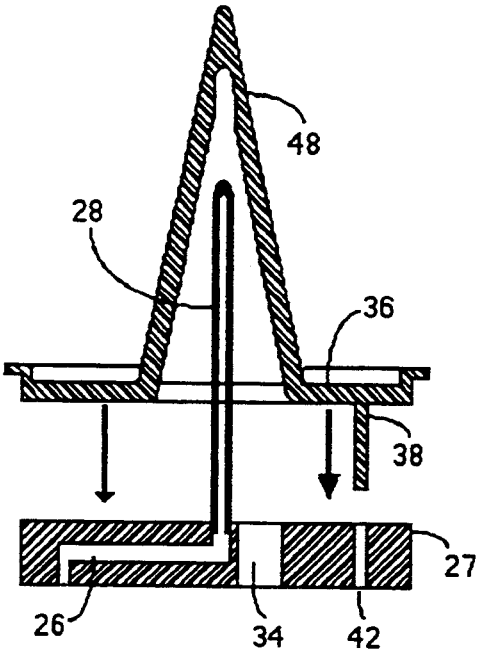
Figure 9:
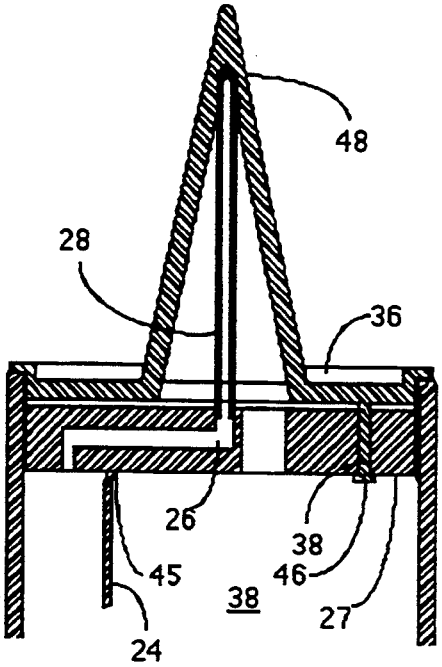
Figure 10:
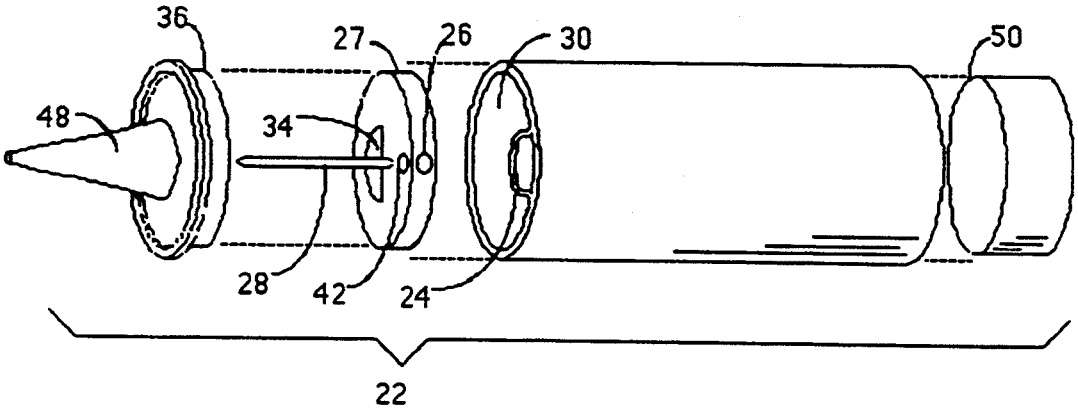
Figure 11:
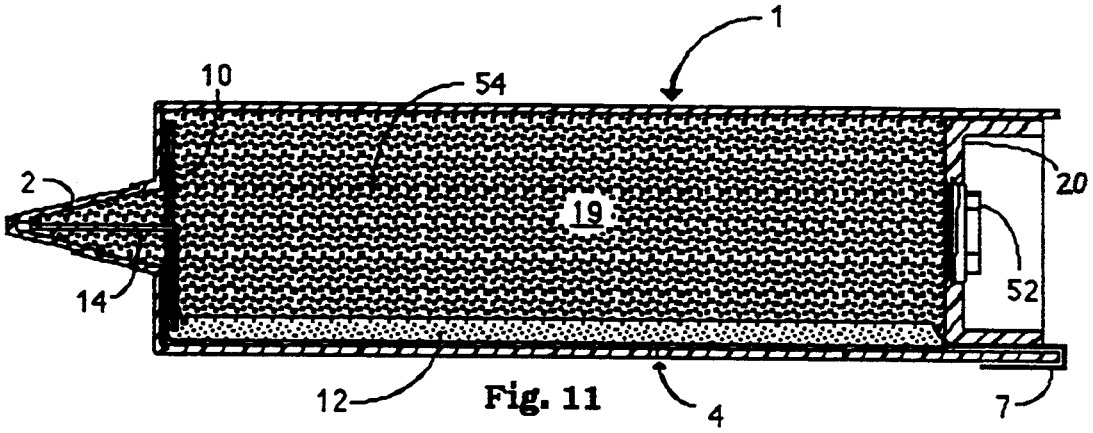
Figure 12:
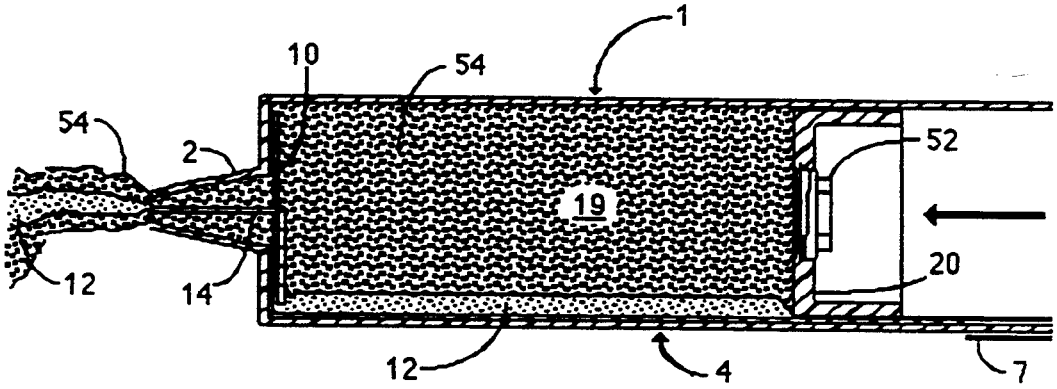
Figure 13:
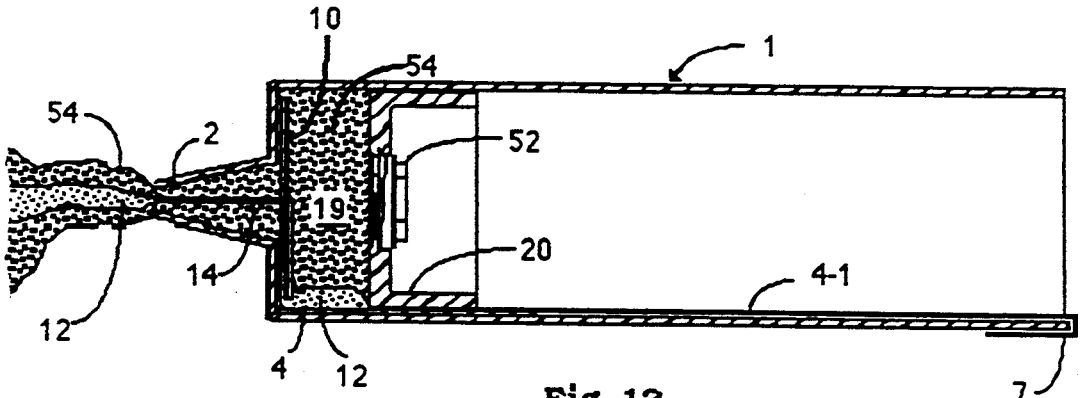
Figure 14:
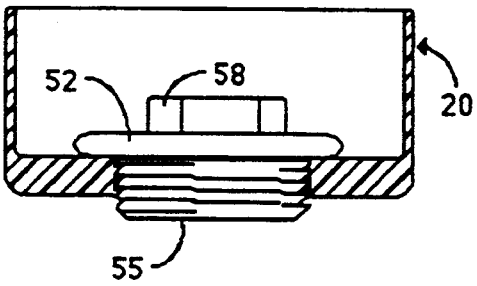
Figure 15:
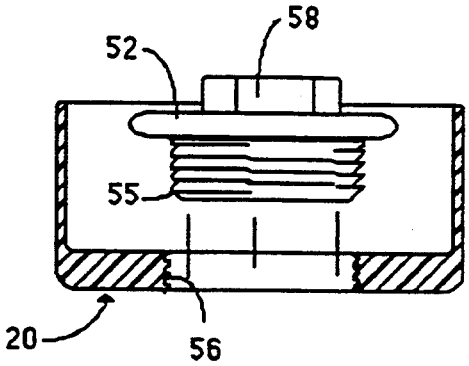
Figure 16:
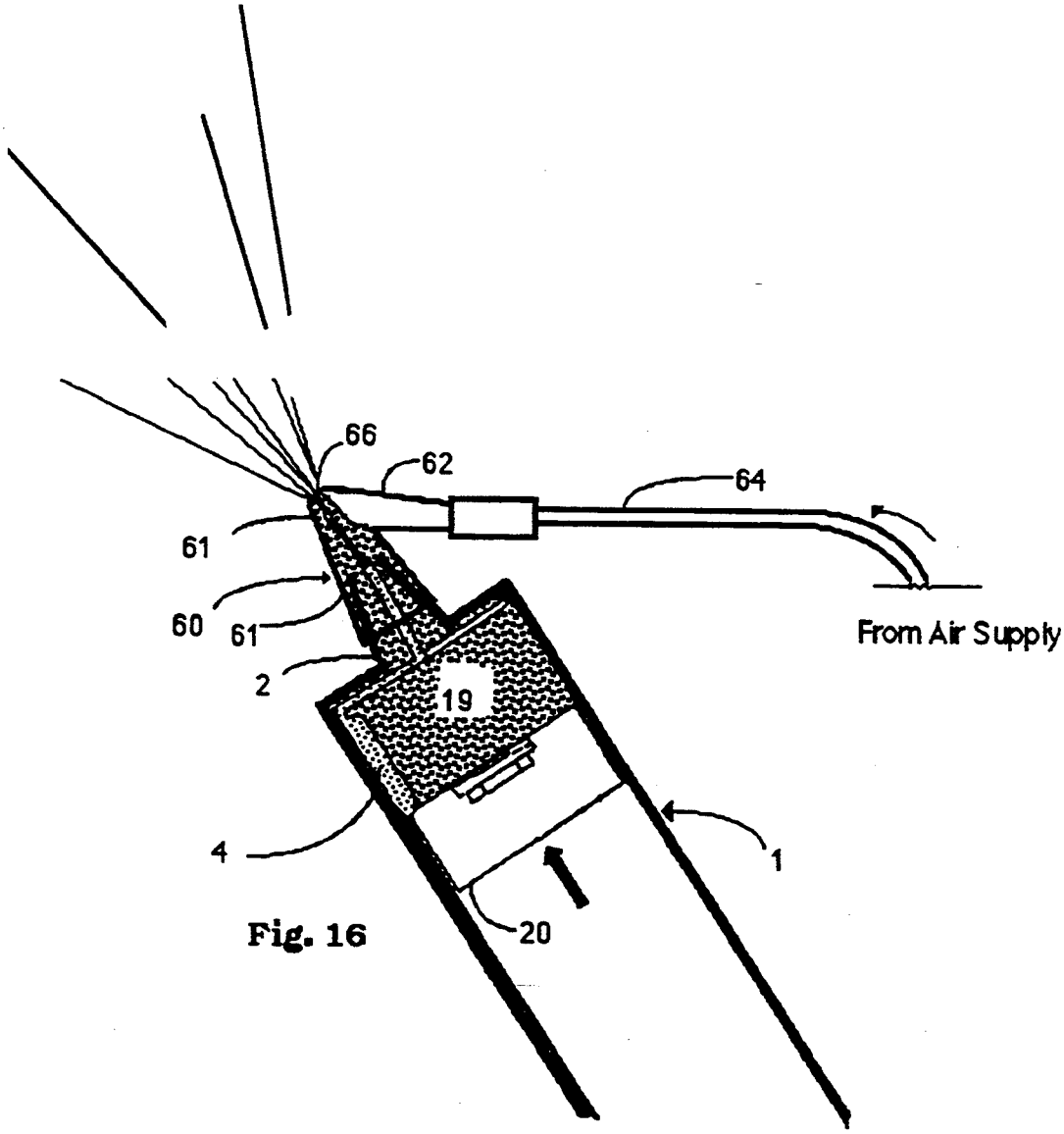

FIGS. *2a*, *2b* and *2c* illustrate the steps for attaching a catalyst containing blister inside the dispensing container FIG. 1;

FIG. 3 is a longitudinally broken away view of a stereo dispensing container according to another embodiment of the present invention;

FIG. 4 is an end view taken along lines 4—4 of FIG. 1;

FIG. 5 is an end view taken along lines 5—5 of FIG. 3;

FIG. 6 shows a cross-section of the distal dispensing end of the container of FIG. 3;

FIG. 7 is a cross-section taken along lines 7—7 of FIG. 6;

FIGS. 8, 9 and 10 illustrate the steps for assembling the dispensing container of FIG. 3;

FIGS. 11, 12 and 13 illustrate the operation of the stereo dispensing container of FIG. 1 for simultaneously dispensing two different materials in predetermined proportions relative to one another;

FIGS. 14 and 15 show a first alternate embodiment of the present invention in the form of a plunger having a removable screw-threaded plug; and FIG. 16 shows a second alternate embodiment of the present invention in the form of a spray tip which permits the materials carried by the stereo dispensing container of FIG. 1 to be uniformly expressed and sprayed by means of air under pressure.

DESCRIPTION OF THE PREFERRED EMBODIMENT

The stereo dispensing container and system which form the present invention is now described while referring to the drawings. Referring initially to FIG. 1, the dispensing container is, in the preferred embodiment, a conventional, low cost, commercially available caulking cartridge 1. That is, caulking cartridge 1 has a cylindrical body that is typically made from plastic, metal or cardboard and commonly used in the building and home improvement industries to dispense caulk, adhesive, and the like. The caulking cartridge 1 has the usual spout 2 projecting from the distal end wall 10 thereof and a plunger 20 initially at rest across the proximal end.

Caulking cartridges have heretofore been filled with a single material to be uniformly dispensed through the spout. In accordance with one aspect of the present invention, a standard, disposable caulking cartridge 1, as described above, is filled with two different materials that can be dispensed at the same time in predetermined proportions relative to one another. More particularly, a flexible blister 4 to be manufactured from a metal foil or tough plastic, runs longitudinally through the interior of the caulking cartridge 1 between the proximal and distal ends thereof.

Figure 2A:
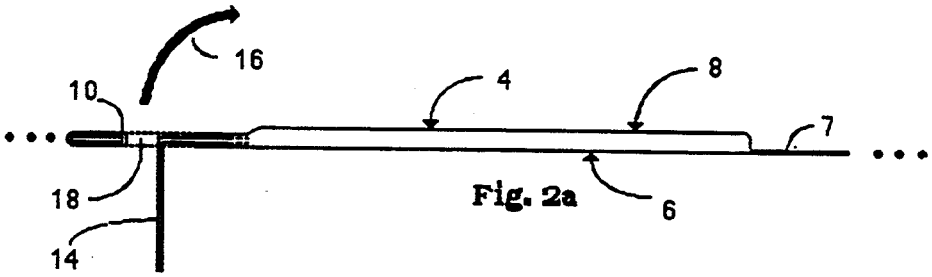
Figure 2B:
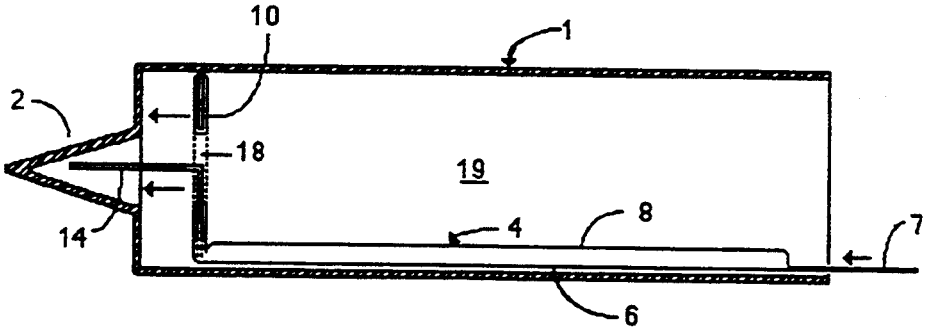

That is, and referring concurrently to FIGS. 1, 2*a*, 2*b*, 2*c* of the drawings, the blister 4 is formed from a long, thin bottom layer 6 which is to be adhesively bonded to the interior of the existing caulking cartridge 1 so as to extend from the distal end of the cartridge, along a side of the cylindrical body thereof, and project beyond the proximal end (best shown in FIG. 2*b*). The projection 7 of the bottom layer 6 adjacent the blister 4 is bent around the proximal end of the cartridge 1 so as to terminate at and be secured to an exterior side of the body in order to provide a surface upon which to list the contents of the blister 4 (best shown in FIG. 2*c*). The blister 4 also includes a top layer 8 which is heat or otherwise sealed to the bottom layer 6 to form an envelope. The top layer 8 of blister 4 rises upwardly from the bottom layer 6 and assumes a generally arcuate shape (best shown in FIG. 4) so that the contents (e.g. a catalyst 12) of the blister 4 can be stored in the space within the envelope between the bottom and top layers 6 and 8. The outside surface of top layer 8 is preferably coated with a lubricant (e.g. a wax) to facilitate the movement and smooth the travel of a plunger 20 through the caulking cartridge 1 and over the blister 4 for a purpose that will soon be described.

Figure 2C:
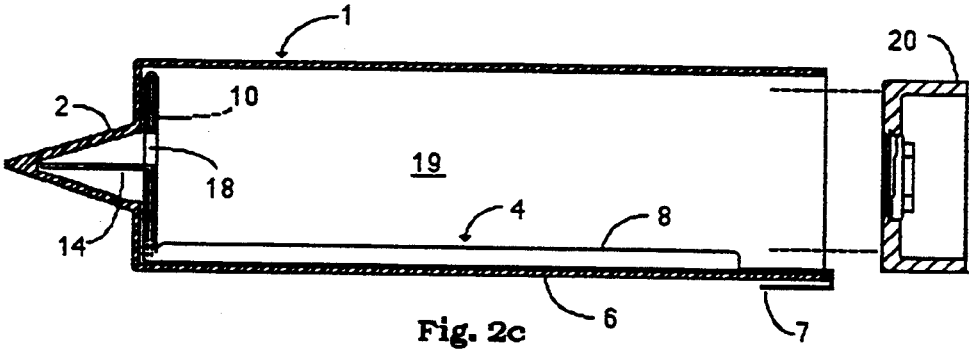

FIGS. 2*a*, 2*b* and 2*c* illustrate the steps by which a blister 4 is attached to the interior of the conventional monaural caulking cartridge 1 of FIG. 1 to form a stereo dispensing container without having to make any manufacturing changes to the cartridge. A series of blisters (one of which being shown in FIG. 2*a*) may be manufactured end-to-end one another (e.g. in a daisy chain) to facilitate the installation of a plurality of such blister within a respective plurality of caulking cartridges. Each blister 4, such as that shown in FIG. 2*a*, is detached from the series of other blisters so as to be inserted in a cartridge 1 and moved towards the distal end from which the spout 2 extends. Each blister 4 of the series of blisters includes the envelope defined by the bottom and top layer 6 and 8 between which the catalyst (e.g. designated 12 in FIG. 4) is stored, the aforementioned projection 7 extending longitudinally from and adjacent one end of the envelope, and a distal end wall 10 extending longitudinally from and adjacent the opposite of the blister envelope. One end of a catalyst outlet tube 14 extends through the distal end wall 10 and communicates with the interior of the blister 4 through the otherwise sealed forward end thereof. The opposite end of outlet 14 projects outwardly through a central passageway 18 formed in the distal end wall 10 and turns at a right angle to the longitudinal plane of end wall 10, blister 4 and projection 7.

During installation, the distal end wall 10 adjacent blister 4 is rotated in the direction of the reference arrow 16 of FIG. 2*a* until the end of the outlet tube 14 extending from distal end wall 10 is axially aligned with the longitudinal axis of the caulking cartridge 1. As shown in FIG. 2*b*, the blister 4 is then pushed through the cartridge 1 towards the spout 2 until the rotated distal end wall 10 adjacent blister 4 is flush with the distal end of the cartridge 1 and the catalyst outlet tube 14 is surrounded by and coaxially aligned with the spout 2. As previously disclosed, the bottom layer 6 of blister 4 is provided with an adhesive by which to enable the blister to be affixed to a side of the cylindrical body of the cartridge. Moreover, the distal end wall 10 may also be covered with an adhesive by which to enable wall 10 to be affixed to the distal end of the cartridge. Lastly, and as is best shown in FIG. 2*c*, the projection 7 adjacent the blister 4 is bent around the proximal end of the cartridge 1 to provide a surface upon which to identify the material stored within the blister.

The remaining interior volume of the caulking cartridge 1, other than the volume consumed by the blister 4, forms a holding chamber 19 for a base material (e.g. a resin) to be mixed in predetermined proportions with the catalyst (12 in FIG. 4) stored in blister 4. The holding chamber 19 communicates directly with the spout 2 of cartridge 1 by way of the aforementioned central passageway 18 through the distal end wall 10. Thus, the catalyst 12 stored in blister 4 is available from the catalyst outlet tube 14, while the base material stored in holding chamber 19 is available from the spout 2 via passageway 18. However, it will be appreciated that the blister 4 isolates the different materials stored in the cartridge 1 until they are expulsed therefrom to form a composite material.

In accordance with a second aspect of the present invention, and referring now to FIG. 3 of the drawings, a caulking cartridge 22 can be constructed during manufacture so as to eliminate the step of adhesively affixing the blister 4 to the interior of the convention caulking cartridge 1 of FIG. 1. That is, instead of forming blister 4 from bottom and top layers 6 and 8 that are sealed one atop the other, a blister wall 24 can be extruded or injection molded longitudinally along a side of the caulking cartridge 22 during manufacture of the cartridge. In this regard, both the cylindrical body of caulking cartridge 22 and the blister wall 24 would be formed from the same material (e.g. a flexible plastic). Like the top layer 8 of the blister 4 of caulking cartridge 1, the blister wall 24 of caulking cartridge 22 has an arcuate shape and is spaced radially inward from the cartridge 22 so that a catalyst 25, or the like, may be stored in the space between catalyst wall 24 and the adjacent side wall of the cylindrical body (best shown in FIG. 5).

As is best shown in FIG. 6 of the drawings, an exit channel 26 communicates with the forward end of the blister formed by blister wall 24 and then extends radially through the distal end wall 27 of the caulking cartridge 22. The forward end of the blister is otherwise sealed against the distal end wall 27 to prevent the inadvertent escape of catalyst. One end of a catalyst outlet tube 28 is bonded to the exit channel 26 at distal end wall 27. The opposite end of the catalyst outlet tube 28 extends longitudinally from the exit channel 26 to be surrounded by and coaxially aligned with the spout 48 of caulking cartridge 22.

The remainder of the manufactured caulking cartridge 22, other than that consumed by the blister defined by blister wall 24, forms a holding chamber 30 for storing a base material 32 (e.g. a resin) which is ultimately to be mixed with the catalyst 25 stored in the blister in predetermined proportions relative to one another. The holding chamber 30 communicates directly with the spout 48 of the cartridge 22 by way of a central passageway 34 formed through the distal end wall 27 of caulking cartridge 22 (best shown in FIG. 7). Thus, the catalyst 25 stored in the blister defined by blister wall 24 of caulking cartridge 22 is available from the catalyst outlet tube 28 via exit channel 26, while the resin 32 stored in the holding chamber 30 of cartridge 22 is available at the spout 48 via passageway 34.

FIGS. 8, 9 and 10 of the drawings illustrate the steps of the joining the spout 48 to the distal end wall 27 to form the caulking cartridge 22 with the catalyst outlet tube 28 and the spout 48 maintained in coaxial alignment with one another and the blister defined by wall 24 communicating with the exit channel 26. More particularly, projecting from the disk-like base 36 of the spout 48 is at least one post 38. An oppositely aligned slot 42 is formed through the distal end wall 27 and sized to receive the post 38 therewithin. One end of the catalyst outlet tube 28 is affixed to the exit channel 26, such that tube 28 projects longitudinally and outwardly from the distal end wall 27. The spout 48 and end wall 27 are permanently mated together with outlet tube 28 surrounded by the spout (best shown in FIG. 9) when the end of the post 38 is received in the slot 42 and melted to form a button head 46. The button head 46 prevents the inadvertent separation of the spout 48 from the distal end wall 27.

The assembled combination of spout 48 and distal end wall 27 is secured to the distal end of the caulking cartridge 22 by means of spin welding, or the like. The holding chamber 30 in which the base material (e.g. resin) is stored is aligned with the passageway 34 to permit communication between holding chamber 30 and spout 48. The forward end of the blister wall 24 is heat or otherwise sealed to the distal wall 27 at a joint 45 to close the blister against the distal wall 27 except for exit channel 26 which allows communication between the blister defined by blister wall 24 and the catalyst outlet tube 28. Lastly, a plunger 50 is located within the proximal end of the caulking cartridge 22 and adapted to move in a direction towards the distal end wall 27. To this end, the blister wall 24 may be coated with a lubricant (e.g. a wax) to facilitate the movement and smooth the travel of the plunger 50 through the caulking cartridge 22 and over the blister defined by wall 24 for a purpose that will now be described.

The operation of the stereo dispensing container (i.e. caulking cartridge 1) of the present invention is now described in detail while referring to FIGS. 11, 12 and 13 of the drawings. FIG. 11 shows the caulking cartridge 1 after the blister 4 has been adhesively affixed thereto in the manner described while previously referring to FIGS. *2a*, *2b* and *2c*. That is to say, the longitudinally extending blister 4 has been pre-filled with a supply of catalyst 12, or other suitable material, and the holding chamber 19 is loaded with base material 54, such as a resin, or the like. The plunger 20 is initially in the at rest condition at the proximal end of cartridge 1 adjacent the sealed rear end of the blister 4.

In FIG. 12, the tips of the formerly closed spout 2 and catalyst outlet tube 14 of caulking cartridge 1 are severed to permit the flow of material outwardly from each. Next, the plunger 20 is moved through cartridge 1 towards the distal end wall 10 thereof. The foregoing may be accomplished by locating the cartridge 1 within and operating a conventional caulking gun (not shown). As the plunger 20 moves distally through the cartridge 1, the volume of the holding chamber 19 established between plunger 20 and end wall 10 and running alongside blister 4, is reduced. Accordingly, the base material 54 stored in holding chamber 19 is expulsed therefrom by way of the spout 2 and the central passageway 18 (of FIG. *2c*) which extends through distal end wall 10 for communication with chamber 19. During its distal travel through the caulking cartridge 1, the plunger 20 will also ride over the blister 4 in which a supply of catalyst 12 has been stored. As a result of the foregoing, the arcuate blister 4 will be progressively compressed or flattened against the cylindrical body of cartridge 1 (best shown in FIG. 13 and designated by reference 4-1). Accordingly, the catalyst 12 will be expulsed from the blister 4 by way of the catalyst outlet tube 14 which communicates with the forward end of the blister (best shown in FIG. *2a*).

The more plunger 20 moves through caulking cartridge 1, the greater will be the reduction in volume of the holding chamber 19 and the compression of blister 4. Thus, more catalyst 12 and base material 54 will be expulsed from the blister 4 and holding chamber 19, respectively. However, and as should now be apparent, the catalyst 12 and base material 54 are dispensed from caulking cartridge 1 in constant proportions relative to one another, regardless of the displacement of plunger 20. Therefore, the guess work that has heretofor been associated with expulsing catalyst and resin from conventional dispensing systems is advantageously eliminated. What is more, the amount of catalyst 12 to be expulsed from cartridge 1 for mixing with the base material 54 can be selectively changed by a manufacturer simply choosing the dimensions of the blister 4 so that a particular ratio of catalyst to base material will be accurately achieved to meet the requirements of the final composite material. Thus, the user is provided with a low cost, fully disposable stereo dispensing container which permits a plurality of ingredients needed to form the composite material (e.g. an epoxy resin) to be efficiently and reliably introduced to one another.

FIGS. 11–13 illustrate the operation of the conventional caulking cartridge 1 (of FIG. 1) within which a prefilled blister 4 has been adhesively affixed. However, it is to be expressly understood that the operation of the modified cartridge 22 (of FIG. 3) within which a catalyst wall 24 is extruded or injection molded during manufacture is identical to the operation of the existing cartridge 1 except that catalyst 25 is expulsed by way of the catalyst outlet 28 and exit channel 26 that extends through the distal end wall 27 of cartridge 22 so as to communicate with the forward end to the blister that is defined by blister wall 24 (best shown in FIG. 6). In addition, the blister wall 24 should be sufficiently thin so that when such wall is deflected (i.e. flattened) against the opposing side of the cartridge cylinder by the plunger 50 riding thereover, the wall 24 will become mechanically invisible to the plunger so as not to impede the continued distal movement thereof.

FIGS. 14 and 15 of the drawings illustrate a first alternate embodiment of the present invention. More particularly, the plunger 20 at the proximal end of caulking cartridge 1 or the plunger 50 at the proximal end of caulking cartridge 22 (not shown) may include a removable, threaded plug 52. The threaded plug 52 has a screw-threaded body 55 that is adapted to be removably received within a correspondingly screw-threaded hole 56 formed through the plunger 20 (best shown in FIG. 15). With the plug 52 removed from plunger 20, the user will be able to load the holding chamber 19 of cartridge 1 with the base material (e.g. 54) and/or a colorant of his choice. In this regard, the threaded plug 52 has a suitably shaped head 58 to facilitate the removal of plug 52 from plunger 20 by means of an appropriate tool (not shown).

FIG. 16 of the drawings illustrates a second alternate embodiment of the present invention. More particularly, a disposable spray tip 60 is positioned over the spout 2 of the caulking cartridge 1. Spray tip 60 includes a hollow body 61 and an air stem 62 extending from body 61 to be attached to a source of air under pressure via suitable flexible tubing 64. In operation, the catalyst and base materials that are expulsed from the blister and holding chamber 4 and 19 of the cartridge 1 are delivered to the body 61 of spray tip 60 by way of spout 2. Accordingly, a uniform mixture of air (supplied to body 61 via tubing 64 and air stem 62), catalyst and base material can be continuously sprayed through an exit orifice 66 formed through an end of the spray tip 60 so as to efficiently and accurately spray a distant surface (not shown). One such spray tip 60 which is suitable for use with caulking cartridge 1 is that described in my previously issued U.S. Pat. No. 4,951,876 issued Aug. 28, 1990.

It will be apparent that while a preferred embodiment of the invention has been shown and described, various modifications and changes may be made without departing from the true spirit and scope of the invention. For example, it is within the scope of this invention to include a plurality of blisters within the caulking cartridge. Each blister would store a different material and communicate with the spout to provide the ingredients for a multi-part composite from a single container.

Having thus set forth the preferred embodiment, what is claimed is:

1. A stereo dispensing container from which first and second materials are simultaneously dispensed, said container comprising:

a caulking tube including a hollow cylindrical body having proximal and distal ends, an interior side wall extending longitudinally through said body between said proximal and distal ends, and a sealed spout connected to and projecting outwardly from said distal end;

a reservoir located within said body for holding a first of the materials to be dispensed, said reservoir and said spout lying in fluid communication with one another;

a flexible blister enclosure for holding the second of the materials to be dispensed, said blister enclosure affixed along the interior side wall of said body between the proximal and distal ends thereof;

a sealed outlet tube lying in fluid communication with said blister enclosure at the distal end of said body, said outlet tube surrounded by said spout so that cutting open said spout simultaneously opens said outlet tube; and a caulking tube plunger located at the proximal end of said body and moving distally therethrough to ride over and compress said flexible blister enclosure for simultaneously expulsing the first material from said reservoir by way of said spout and said second material from said flexible blister by way of said outlet tube and mixing said first and second materials together.

2. The stereo dispensing container recited in claim 1, further comprising a hollow spray tip attached to and surrounding the spout of said caulking tube body, said spray tip having an exit orifice and an air inlet opening, said spray tip receiving a supply of air under pressure at said air inlet opening for causing a mixture of the first and second materials expulsed from said spout and said outlet tube to be sprayed through said exit orifice.

3. The stereo dispensing container recited in claim 1, further comprising an opening formed in said caulking tube plunger and a plug removably received in said opening, said plug being removed from said opening to permit access to the reservoir located within said caulking tube body by way of said opening.

4. The stereo dispensing container recited in claim 1, further comprising a distal end wall extending laterally across the distal end of said caulking tube body, and a fluid channel extending through said distal end wall between said blister enclosure and said outlet tube to place said blister enclosure and said outlet tube in fluid communication with one another.

5. The stereo dispensing container recited in claim 4, further comprising a fluid passageway extending through said distal end wall between said reservoir located within said caulking tube body and the spout extending from said body to place said reservoir and said spout in fluid communication with one another.

6. The stereo dispensing container recited in claim 4, wherein said distal end wall is pivotally connected to said blister enclosure so that said end wall is rotatable from a first position in generally parallel alignment with said blister enclosure in a direction extending longitudinally through said caulking tube body to a second position in generally perpendicular alignment with said blister enclosure in a direction extending laterally across said body at the distal end thereof.

7. The stereo dispensing container recited in claim 4, further comprising a post extending from the spout of said caulking tube body and a slot formed through said distal end wall, said post received in said slot to connect said spout to said distal end wall.

8. The stereo dispensing container recited in claim 1, wherein said blister enclosure is extruded along the interior side wall of said caulking tube body, said blister enclosure and said body being manufactured from an identical flexible plastic material.

9. The stereo dispensing container recited in claim 1, wherein said blister enclosure is molded along the interior side wall of said caulking tube body, said blister enclosure and said body being manufactured from an identical flexible plastic material.

10. The stereo dispensing container recited in claim 1, wherein the first material held in said reservoir is a resin and the second material held in said flexible blister enclosure is a catalyst.

11. The stereo dispensing container recited in claim 1, wherein said flexible blister enclosure is covered by a lubricant to facilitate said caulking tube plunger riding over and compressing said blister enclosure to expulse the second material therefrom.

12. The stereo dispensing container recited in claim 1, wherein said caulking tube is an industry standard monaural caulking tube.

* * * * *